United States Patent [19]

Van Bergen

[11] 4,188,798

[45] Feb. 19, 1980

[54] EAR CLIP WITH FRICTION-RETAINED GRIPPING PORTIONS

[76] Inventor: Johannes A. W. P. Van Bergen, 109 Westward Deals, Kedington, Haverhill, Suffolk, England

[21] Appl. No.: 849,044

[22] Filed: Nov. 7, 1977

Related U.S. Application Data

[63] Continuation of Ser. No. 724,970, Sep. 20, 1976, abandoned.

[30] Foreign Application Priority Data

Oct. 1, 1975 [GB] United Kingdom ..... 40113/75

[51] Int. Cl.[2] ..... A44B 21/00

[52] U.S. Cl. ..... 63/14 C; 24/248 R

[58] Field of Search ..... 63/14 R, 14 A, 14 B, 63/14 C, 14 D, 14 E, 14 F; 24/248 R, 252

[56] References Cited

U.S. PATENT DOCUMENTS 2,788,559 4/1957 Bazner ..... 63/14 C 3,654,774 8/1969 Van Bergen ..... 63/14 C

FOREIGN PATENT DOCUMENTS 803890 7/1936 France ..... 63/14 C 976341 11/1974 United Kingdom ..... 63/14 C

*Primary Examiner*—F. Barry Shay

*Attorney, Agent, or Firm*—Irving M. Weiner; Pamela S. Burt; Melvin Yedlin

[57] ABSTRACT

A two-part ear ornament clip of known type, whose pivotally connected front and back parts are so dimensioned and connected to one another that, in the open condition of the clip, the front part is supported by the back part in a manner which greatly facilitates the handling and application of said clip by the wearer to her ear lobe. Moreover, said front and back parts are such that, when said parts are in their lobe-gripping positions relative to one another, the portion of the front part to which the ornament would be secured is directly opposite the portion of the back part which is in contact with the inside face of the ear lobe.

2 Claims, 10 Drawing Figures

22
23
21
X
26
25
27
28
24
20

30
29
20

40
42
41
Y
43

42
44
45
45

EAR CLIP WITH FRICTION-RETAINED GRIPPING PORTIONS

This is a continuation of application Ser. No. 724,970, filed Sept. 20, 1976, now abandoned.

This invention relates to ear ornament clips.

An ear ornament clip construction is disclosed in United Kingdom Pat. No. 976,341 and the form in which the ear ornament clip disclosed in that Specification has been marketed in the United Kingdom and overseas at least during the last ten years is illustrated in FIGS. 1 and 2 of the accompanying drawings.

FIG. 1 of said drawings illustrates a first clip member 10 (hereinafter called the front part) and a second clip member 11 (hereinafter called the back part) which are pivotally connected to one another at 12, the back part being in the position which it is able to occupy, and will in practice occupy, when the two parts have been separated to release the lobe of the ear. This condition of the clip (and indeed of any ear ornament clip) will be hereinafter referred to as the fully open condition. It will be appreciated that in order to enable a woman to apply the clip and the ornament carried thereby to the lobe of her ear, it will be necessary for her to put, say, her index finger in contact with the front surface of the ornament 13 and the tip of her thumb in contact with the surface 14 of the back part 11. However, instead of being able simply to squeeze the front part 10 and the back part 11 towards one another, she must first push said back part upwardly about the pivotal axis 12 relative to the front part 10 in order to bring that back part into the position thereof which is illustrated in FIG. 2 of the accompanying drawings.

In practice, this necessity proves to be a complication from the women's point of view because the ear ornament clip is extremely small and its smallness makes it very easy for a women to drop the clip in the course of trying to apply it to the lobe of an ear. In fact, the smaller the ornament 13 is, the more difficult is the task of application of the clip to the ear. If the ornament were circular and of the diameter shown in FIG. 2 in full line, it would be relatively easy for the tip of the index finger and the ball of the thumb to exert a clip-closing force along, i.e., the line A—A shown in FIG. 2 whereas, if the ornament (for example, a small pearl) were to be of the size shown in dotted line in FIG. 2, the ability of the woman to exert pressure along the line A—A without either the index finger of the thumb slipping off would diminish very considerably because the index finger would have much less area of ornament to which to apply the force. In fact, in experiments which have been conducted, particularly when the ornament carried by the front part 10 is very small, it has been found that (with the front and back parts in the FIG. 2 positions) the index finger and thumb sometimes exert the force along the line B—B because the thumb is not actually far enough along the back part 11 towards the curved end part 15 thereof. Discovery of this necessitates re-positioning of the clip carefully between the tips of the index finger and thumb and even then the closure of the clip to the lobe-gripping condition thereof can be quite a slow process.

SUMMARY OF THE INVENTION.

The principal object of the present invention is to provide a clip construction in which the drawback discussed above is overcome completely, or at least significantly reduced.

Accordingly, the present invention consists in an ear ornament clip which comprises a front part and a back part so connected to one another as to permit angular movement of said parts relative to one another in order to grip or release the lobe of the wearer's ear.

(a) said front part having a first portion of which one face is adapted to carry the ornament and of which the other face is adapted to be placed in contact with that surface of the lobe of the wearer's ear against which said ornament is to be displayed;

(b) said front part having a second portion which is integral and said first portion and which includes elements which are so joined to one another at corresponding one ends thereof as to form resilient elements in the form of a V, the corresponding other and free ends of said elements being directed towards said first portion of the front part;

(c) a generally C-shaped back part which has a first portion which includes a face which is adapted to be placed in contact with that surface of the lobe of the wearer's ear which is remote from said surface thereof against which said ornament is to be displayed;

(d) said back part having a second portion which is integral with the first portion thereof and which comprises substantially parallel legs;

(e) said front part having first means located near said resilient elements and said back part having second means located near the free ends of said legs, said first means and said second means being complementary and coacting to form a pivotal connection between the front and back parts;

(f) said generally C-shaped configuration of said back part being such that, in the fully open condition of the ear ornament clip, that end or end portion of said back part which is remote from said free ends of said legs is in contact with the free end of at least one of said resilient elements;

(g) angular movements of the front and back parts relative to one another from said fully open condition to the condition in which the lobe of an ear becomes gripped between the first portion of the front part and the first portion of the back part not only causing the lobe-gripping portions of said front and back parts of the clip to become disposed directly opposite to one another but also causing the inside surfaces of said legs to slide with friction along the outside surfaces of said resilient elements together to establish and to maintain the desired lobe-gripping condition of said front and back parts.

Preferably, said back part further includes a projecting nib which is integral with said first portion thereof and which is located between said face and said second portion thereof, said nib being shaped and provided to facilitate manual engagement of the back part preparatory to manual exertion of pressure on the front and back parts in order to close the clip into its lobe-gripping condition.

The present invention further consists in an ear ornament clip which is constructed, arranged and operable substantially as hereinafter described with reference to and as illustrated in FIGS. 3 to 9 of the accompanying drawings.

DETAILED DESCRIPTION

Figure 10:
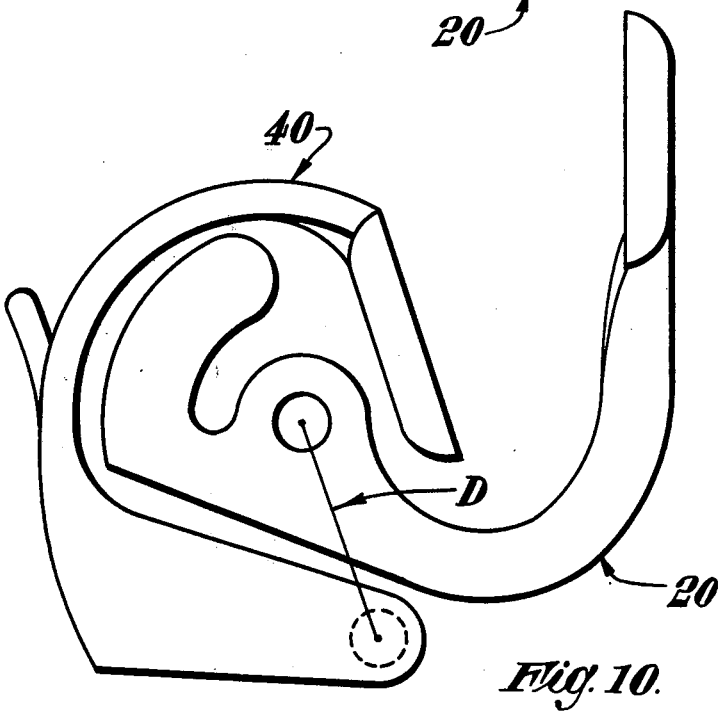

FIG. 10 shows the two parts positioned for assembly.

Figure 3:
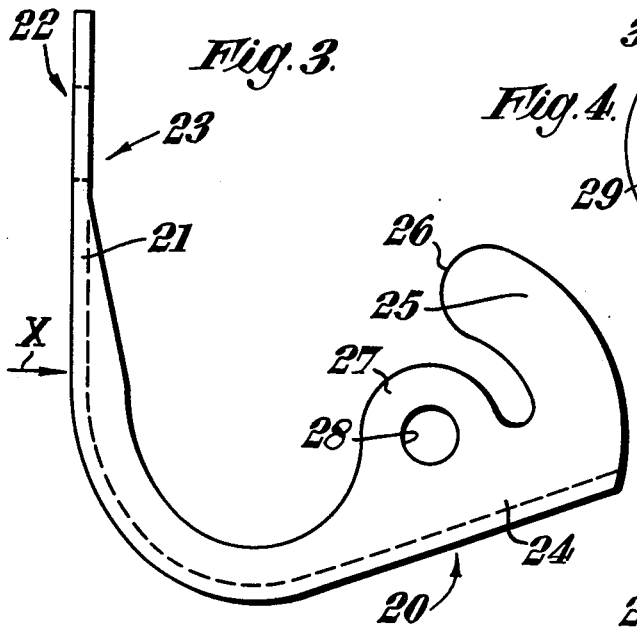
FIG. 3 illustrates a side elevation of the front part of the clip according to the present invention.
Figure 4:
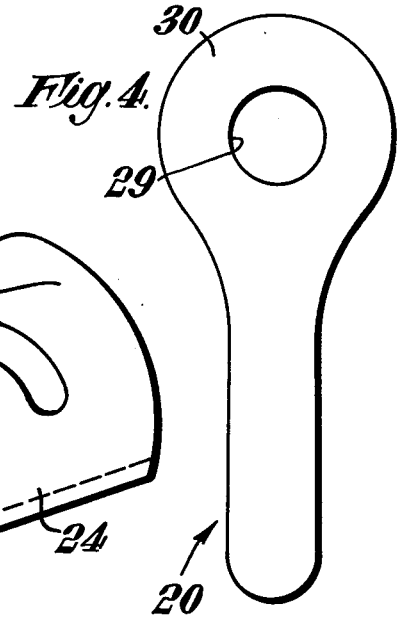
FIG. 4 illustrates a front view of said front part, looking in the direction of the arrow X in FIG. 3.

Referring to FIGS. 3 and 4, there is illustrated therein a front part 20 of the two-part ear ornament clip according to the present invention, said front part having a first portion 21 of which one face 22 is adapted to carry the ornament (not illustrated) and of which the other face 23 is adapted to be placed in contact with that surface of the lobe of the wearer's ear against which said ornament is to be displayed. The front part 20 also has a second portion 24 which is integral with the first portion 21 and which includes elements 25 which are so joined to one another at corresponding one ends thereof as to form resilient elements in the form of a V, the corresponding other and free ends 26 of the resilient elements 25 being directed towards the first portion 21. It will be appreciated that only one of the divergent elements 25 is visible in FIG. 3, the other one being of identical shape and being directly behind the one which is visible. Located near said resilient elements 25 are two lugs 27, in which coaxial apertures 28 are formed, only one of the lugs and the aperture therein being visible in FIG. 3 for the same reason as has been given above in relation to the elements 25. The first portion 21 has an aperture 29 in the enlarged free end 30 thereof, said end 30 and the aperture 29 being necessary for the support and attachment of some kinds of ornament.

Figure 5:
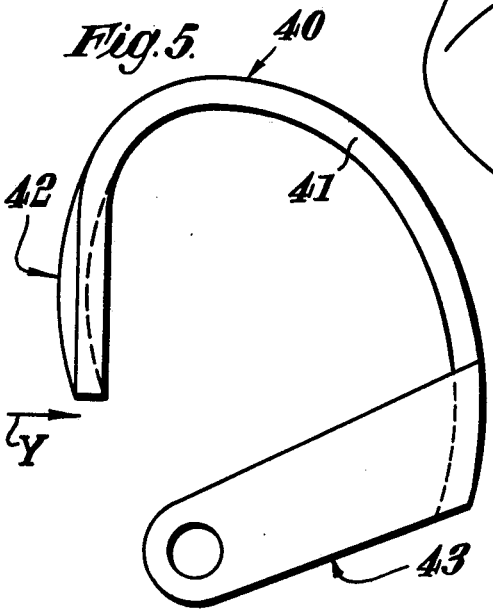
FIG. 5 illustrates a side elevation of the back part of the clip according to the present invention.
Figure 6:
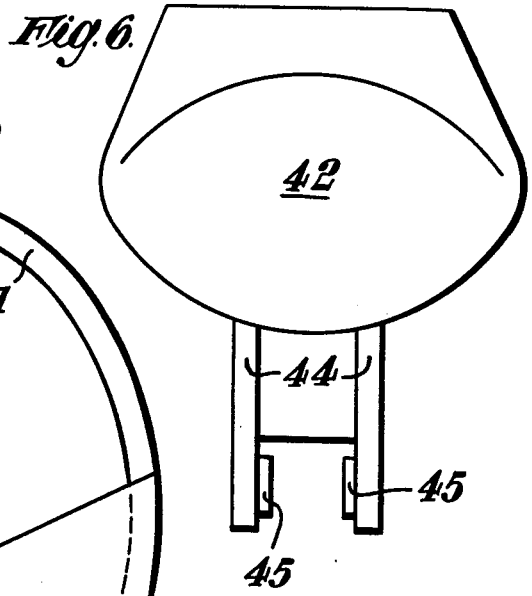
FIG. 6 is a front view of said back part looking in the direction of the arrow Y in FIG. 5.

Referring to FIGS. 5 and 6, there is illustrated therein a generally C-shaped back part 40 of said two-part ear ornament clip, said back part 40 having a first portion 41 which includes a face 42 which is adapted to be placed in contact with that surface of the lobe of the wearer's ear which is remote from said surface thereof against which the ornament is to be displayed. Said back part 40 also comprises a second portion 43 which is integral with the first portion 41 and which is constituted by substantially parallel legs 44. Each of the legs 44 has near the free end thereof a protuberance or pip 45 formed by upsetting, the pips 45 being coaxial and extending towards one another as seen in FIG. 6. The circle seen in FIG. 5 near the free end of the one visible leg 44 is the depression which was formed in that face of the leg when the pip 45 was upset.

Figure 7:
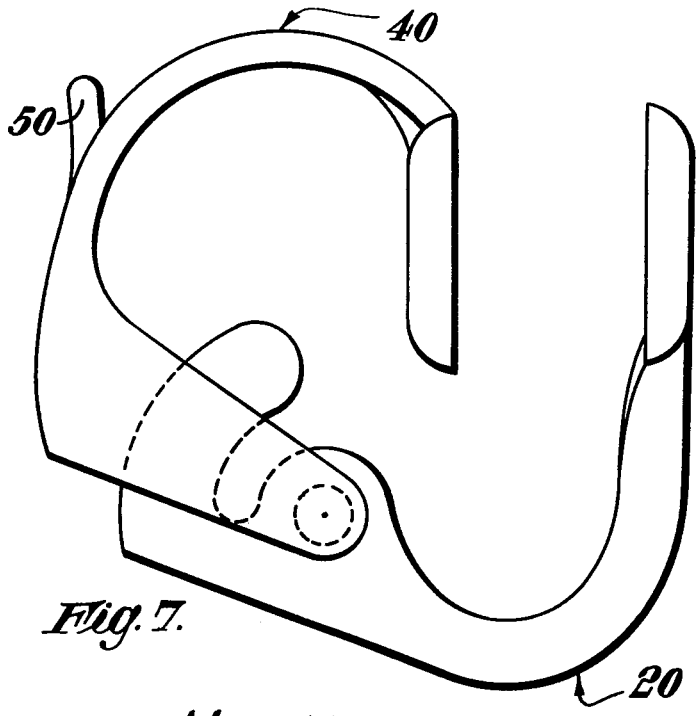
FIGS. 7, 8 and 9 illustrate various conditions of the assembled front and back parts.
Figure 9:
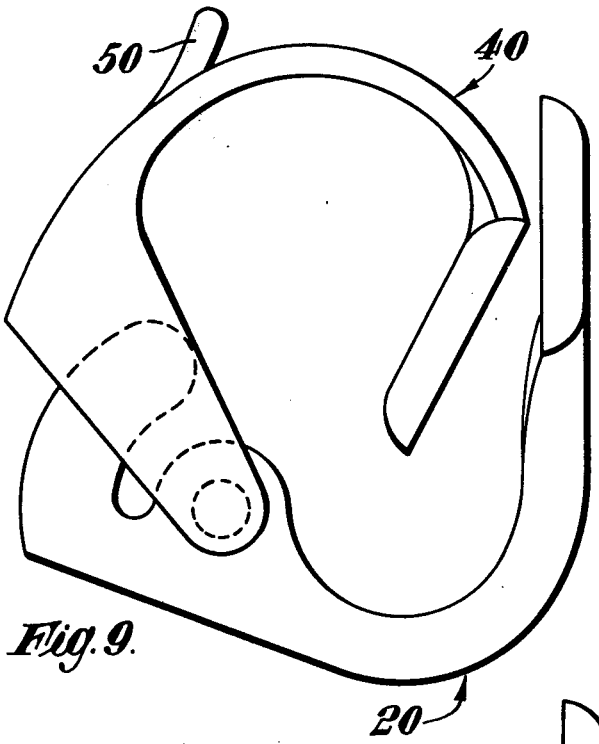

Referring now to FIGS. 7 and 9, it will be seen, firstly, that the back part 40 is also preferably provided with a projecting nib 50 which will be formed by cutting and upsetting the material of the first portion 41. The illustrated location of the nib 50 may need to be altered, possibly by moving it further away from the legs 44 towards the face 42. The purpose of the nib 50 will be described below.

Figure 8:
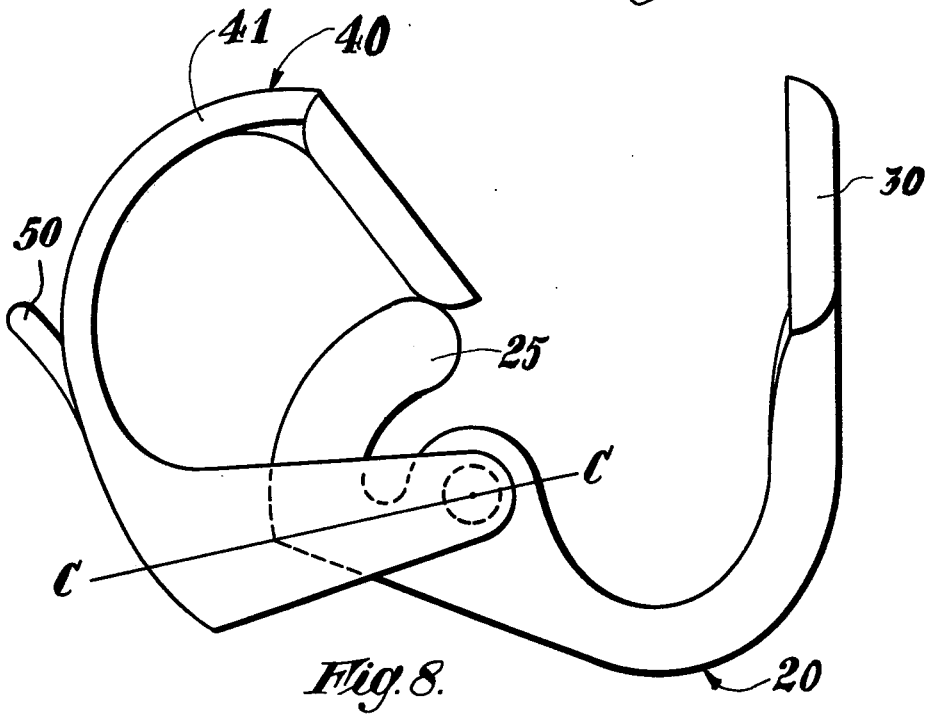

The front part 20 and the back part 40 are brought together to cause the coaxial pips 45 to snap into the coaxial apertures 28, both of the clip parts being made of a springy material (for example, spring steel). In FIG. 8, the front and back parts 20, 40 are shown in the fully open condition in which, (a) the inside surfaces of the substantially parallel legs 44 are no longer in frictional engagement with the outer surfaces of the divergent resilient elements 25; and (b) the free end of the first portion 41 of the back part 40 is in contact with the free end of at least one of the elements 25 of the front part 20.

In this fully open condition of the clip, a woman will not need to make any such preliminary adjustment of the back part relative to the front part as was described above with reference to FIGS. 1 and 2. All that she will need to do is to pick up the ear ornament clip and to press the front and back parts 20, 40 together to bring them into the lobe-gripping condition thereof which is illustrated in FIG. 7. Although the angle through which the back part 40 needs to be moved relative to the front part 20 is approximately 40° (as can be measured by comparing FIGS. 7 and 8), the inside surfaces of the legs 44 contact the outside surfaces of the divergent elements 25 at a very early stage of the angular movement of the back part 40 about the pivotal axis provided by the interengaged pips 45 and apertures 28. Thus, the degree of friction which is ultimately necessary to maintain the clip parts in the relative positions thereof shown in FIG. 7 begins to be developed almost as soon as the back part 40 is moved angularly relative to the front part 20. Of course, the friction developed between the legs 44 and the divergent elements 25 increases as said elements are constrained to become less divergent, and reaches a degree in the FIG. 7 position of the back part 40 which will maintain that setting of the clip parts.

The nib 50 is intended not only to give the tip of a woman's thumb something to push against in order to close the clip, but also to give the woman something to engage with her thumbnail in order to open the clip. The precise location of the nib 50 will have to be determined by trail and error but the nearer it is to the surface 42 of the back part 40, the better, because the force applied between the tip of the thumb and the tip of the index finger will act along a line which is as far as is feasible from the pivotal axis of said front and back parts 20, 40. Moreover, it is thought that if the tip of the thumb has the nib 50 to push against and if the curvature of the C-shaped back part 40 will actually cause the tip of the thumb to slide along the first portion 41 until the nib 50 is reached, any tendency of the thumb to apply pressure along the line C-C in FIG. 8 will be reduced, if not eliminated.

FIG. 9 illustrates the ear ornament clip in an artificial condition in that it cannot be used in that condition. However, it is of interest to note that, in the FIG. 9 condition, the entire ear ornament clip (in its most popular size) is contained within a rectangle measuring 1 cm. by 12 mm.

The free end of the back part 40 is shown in FIG. 8 as being supported by the free end of at least one of the elements 25. However, this contact between free ends is not essential; the same desired effect could be obtained for example, by contact between the free end of the back part 40 and the top edge of at least one of the elements 25 or by contact between the free end of at least one of the elements 25 and a portion of the lobe-contacting part of the portion 41 of the back part 40.

The end 30 shown in FIG. 4 is suitable for riveting, soldering or spot welding in order to secure the ornament thereto. However, said end may be altered to provide for securing an ornament by an adhesive, or by heat (heated tabs on said end being pressed into an ornament made of a synthetic resin material) and to provide for the securing of a pearl bouton ornament.

Figure 1:
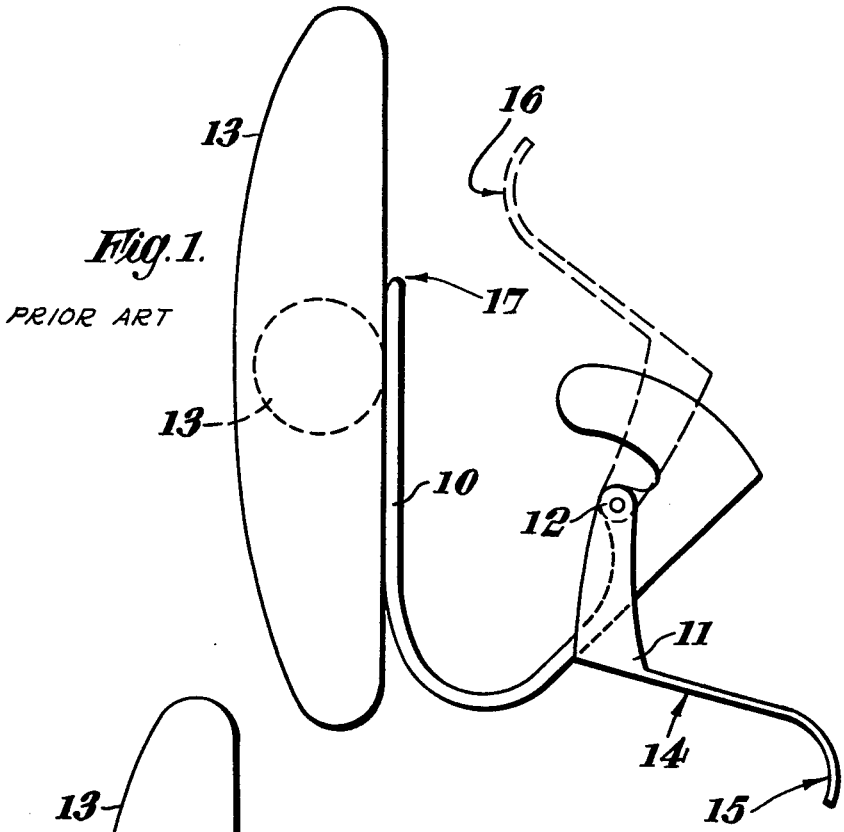
Fig. 1. PRIOR ART
FIGS. 1 and 2 illustrate a prior art ear ornament clip.
Figure 2:
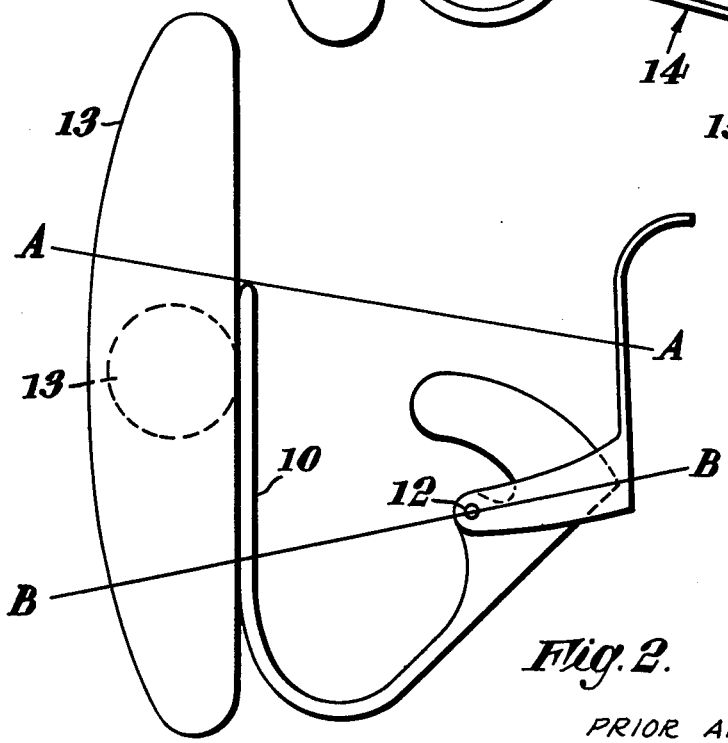
Fig. 2. PRIOR ART

In addition to the already mentioned advantages which are obtainable from the clip according to the present invention, two more advantages may be mentioned. The first, which is of importance to the user, can be appreciated from a comparison of FIGS. 1 and 7. In FIG. 1, the back part 11 is drawn in dotted lines in approximately the position in which it occupies when the lobe is gripped between the front part 10 and the back part 11. However, it will be noticed that the surface 16 of the curved end part 15 of the back part 11 is not in horizontal alignment with the top edge 17 of the front part 10; this does not give rise to any awkwardness when the ornament is large (as drawn in full line, marked 13) but could give rise to awkwardness and possibly some discomfort when the ornament is small (as shown in dotted line, marked 13). In FIG. 7, it will be seen that the two portions which will actually grip the lobe between them are in exact horizontal alignment, and such is clearly the optimum arrangement because the grip does not depend for effectiveness and comfort on the size of the ornament.

The second advantage, which is of importance to any person or firm which has to assemble the front and back parts 20, 40, is that by positioning the said parts as illustrated in FIG. 10 of the accompanying drawings, their assembly is completed simply by moving the two parts together in such a manner that the centers of the apertures 28 move along the line D which joins the centers of the pips 45. Indeed, due to the shapes of the front and back parts 20, 40, it is impossible to assemble those parts in any other way and this means that said parts cannot ever be assembled in the wrong way around relative to one another. The clip parts 10, 11 in FIGS. 1 and 2 can, on the contrary, be assembled correctly or incorrectly and it is immediately apparent, upon incorrect assembly having taken place, that something is wrong which can only be rectified by the assembled parts being taken apart again and then being correctly assembled.

The resilient elements 25 can either be inherently resilient as a result of the material chosen for the maufacture of the clip parts (for example, spring steel) or be given the necessary springiness by placing elastic means between the elements if the clip parts are made of a precious metal. Such elastic means and their design and mode of use in a precious metal ear ornament clip are described and illustrated in United Kingdom Pat. No. 1,285,245 and U.S. Pat. No. 3,654,774. Consequently, any reference to "resilient elements" in the appended Claims is to be interpreted as including elements to which the necessary springiness has been imparted by such elastic means.

I claim:

1. An ear ornament clip which comprises a front part and a back part so connected to one another as to permit angular movement of said parts relative to one another in order to grip or release the lobe of the wearer's ear, (a) said front part having a first portion of which one face is adapted to carry the ornament and of which the other face is adapted to be placed in contact with that surface of the lobe of the wearer's ear against which said ornament is to be displayed;

(b) said front part having a second portion which is integral with said first portion and which includes elements which are so joined to one another at corresponding one ends thereof as to form resilient elements in the form of a V;

(c) said back part comprising a generally C-shaped back part which has a first portion which includes a face which is adapted to be placed in contact with that surface of the lobe of the wearer's ear which is remote from said surface thereof against which said ornament is to be displayed;

(d) said back part having a second portion which is integral with the first portion thereof and which comprises substantially parallel legs;

(e) said front part having first means located near said resilient elements and said back part having second means located near the free ends of said legs, said first means and said second means being complementary and coacting to form a pivotal connection between the front and back parts;

(f) angular movement of the front and back parts relative to one another to a condition in which the lobe of an ear becomes gripped between the first portion of the front part and the first portion of the back part causing the lobe-gripping portions of said front and back parts of the clip to become disposed directly opposite to one another and causing the inside surfaces of said legs to smoothly slide with linearly-increasing friction along the outside surfaces of said resilient elements towards said free ends of said resilient elements and to force the divergent resilient elements together to establish and to maintain the desired lobe-gripping condition of said front and back parts;

(g) said elements of said second portion of said front part which are so joined to one another at corresponding one ends thereof as to form resilient elements in the form of a V having corresponding other and free ends which are directed towards said first portion of the front part; and (h) said generally C-shaped configuration of said back part is such that in the fully open condition of the ear ornament clip, that end portion of said back part which is remote from said free ends of said legs is in contact with at least one of said resilient elements.

2. An ear ornament clip according to claim 1, wherein:

said back part further includes a projecting nib which is integral with said first portion thereof and which is located between said face and said second portion thereof, said nib being shaped and provided to facilitate manual engagement of the back part preparatory to manual exertion of pressure on the front and back parts in order to close the clip into its lobe-gripping condition.

* * * * *